United States Patent [19]

Mathis et al.

[11] 4,449,826

[45] May 22, 1984

[54] APPARATUS FOR PREPARING MORTAR OR THE LIKE

[75] Inventors: Paul Mathis, Merdingen; Anton Wachter, Hindelang, both of Fed. Rep. of Germany

[73] Assignees: Mathis Systemtechnik GmbH, Merdingen; Wachter KG Baustoffwerk, Hindelang/Allgäu, both of Fed. Rep. of Germany

[21] Appl. No.: 316,685

[22] Filed: Oct. 30, 1981

[30] Foreign Application Priority Data

Oct. 31, 1980 [DE] Fed. Rep. of Germany ..... 3041107

[51] Int. Cl.[3] ..... B28C 1/16; B28C 5/14

[52] U.S. Cl. ..... 366/13; 366/15; 366/28; 366/42; 366/66; 366/104; 366/195; 366/329

[58] Field of Search ..... 366/17, 606, 20, 27, 366/24, 35, 38, 50, 66, 64, 156, 157, 319, 322, 323, 290, 318, 29, 33, 42, 131, 139, 28, 10–13, 15, 101–107, 184, 189, 191, 163, 192, 193, 194–196, 325, 329; 261/146, 147, 133, 136

[56] References Cited

U.S. PATENT DOCUMENTS

| | | | |
|---|---|---|---|
| 2,320,469 | 6/1943 | Rasmussen | 366/104 |
| 2,445,928 | 7/1948 | Sommer | 366/104 |
| 4,117,547 | 9/1978 | Mathis et al. | 366/17 |
| 4,223,996 | 9/1980 | Mathis et al. | 366/27 |

FOREIGN PATENT DOCUMENTS

| | | |
|---|---|---|
| 1007684 | 1/1955 | Fed. Rep. of Germany . |
| 1607770 | 10/1967 | Fed. Rep. of Germany . |
| 1924922 | 5/1970 | Fed. Rep. of Germany . |
| 2523374 | 5/1975 | Fed. Rep. of Germany . |
| 2543379 | 9/1975 | Fed. Rep. of Germany . |
| 542648 | 10/1973 | Switzerland . |

*Primary Examiner*—Timothy F. Simone
*Attorney, Agent, or Firm*—Peter K. Kontler

[57] ABSTRACT

The percentage of entrapped air in mortar, plaster, concrete or a like building material which is prepared on a continuous basis is increased, preferably by at least 100 percent, by providing a mixing chamber with one or more barriers which oppose the progress of a mixture of solid and liquid constituents toward the outlet so that each increment of the mixture dwells in the mixing chamber for a relatively long interval of time which exceeds 15 seconds and can even exceed 40 or 50 seconds. The mixing chamber defines a sump for a supply of the mixture, and the rate at which the material leaves the chamber equals or approximates the rate of admission of constituents into the chamber so that the quantity of material which forms the supply is constant. Such supply is agitated by blades, paddles, vanes, grates, lattices or like devices to ensure continuous penetration of air into the material which dwells in, as well as the material which advances through, the mixing chamber. The barrier or barriers may form part of the mixing chamber or they may constitute discrete parts in the form of rings, discs, vanes, paddles or the like, normally in the region of the outlet. Each barrier may but need not rotate with the agitating elements in the interior of the mixing chamber. The mixing chamber can be used in lieu of conventional mixing devices or at the discharge end of a conventional mixing device.

55 Claims, 9 Drawing Figures

APPARATUS FOR PREPARING MORTAR OR THE LIKE

CROSS-REFERENCE TO RELATED CASES

The apparatus of the present invention constitutes an improvement over and a further development of apparatus disclosed in U.S. Pat. No. 4,223,996 granted Sept. 23, 1980 to Paul Mathis et al. The disclosure of U.S. Pat. No. 4,223,996, as well as the disclosure of U.S. Pat. No. 4,117,547 granted Sept. 26, 1978 to Paul Mathis et al. and mentioned in U.S. Pat. No. 4,223,996, is incorporated herein by reference.

BACKGROUND OF THE INVENTION

The present invention relates to a method of and to an apparatus for preparing concrete, plaster, mortar or like materials. For the sake of simplicity, the following description will refer to the preparation of mortar with the understanding, however, that the invention can be resorted to with equal advantage in connection with the making of plaster, concrete or other building materials wherein one or more granular or pulverulent solid constituents are mixed with one or more liquid constituents.

The aforementioned U.S. Pat. No. 4,223,996 discloses an apparatus for continuously mixing solid and liquid constituents of mortar or the like, e.g., for continuously mixing metered quantities of cement with metered quantities of water. The patented apparatus employs a horizontal housing with an inlet for the solid constituent, a feed screw which transports the solid constituent lengthwise into a mixing device, an inlet for the liquid constituent, and means for thoroughly intermixing the two constituents in the interior of the mixing device. Metering means are provided to regulate the rate of admission of solid and liquid constituents into the mixing device. As a rule, the metering means for the solid constituent constitutes or includes an intermediate chamber which is disposed between the mixing device and a first chamber receiving the solid constituent from a suitable source of supply. The patented apparatus operates quite satisfactorily. However, many presently utilized building materials should exhibit highly pronounced heat-insulating properties such as can be imparted by introduction of substantial quantities of air into the mixture of solid and liquid constituents. Heretofore known apparatus are not capable of ensuring the addition of requisite quantities of air, especially when the mixture is prepared on a continuous basis.

OBJECTS AND SUMMARY OF THE INVENTION

An object of the invention is to provide a novel and improved method of producing mortar or like building materials consisting of a mixture of one or more solid constituents and one or more liquid constituents.

Another object of the invention is to provide a novel and improved method of producing mortar or like building materials which exhibit highly satisfactory heat-insulating properties.

A further object of the invention is to provide a novel and improved method of producing mortar or like building materials wherein the percentage of air is incomparably and often several times higher than in heretofore known building materials.

An additional object of the invention is to provide a method of the just outlined character which allows for the production of mortar or like building materials, with a high percentage of entrapped air therein, on a continuous basis.

Still another object of the invention is to provide a method which can be practiced by resorting to relatively simple, inexpensive and versatile apparatus.

A further object of the invention is to provide a novel and improved apparatus which can be used for the practice of the above outlined method and is capable of ensuring the entrapment of large quantities of properly distributed air in the building material.

An ancillary object of the invention is to provide the apparatus with novel and improved means for ensuring the entrapment of large quantities of air in the mixture of solid and liquid constituents.

Another object of the invention is to provide the apparatus with novel and improved means for selecting the quantity of entrapped air in the aforementioned mixture.

A further object of the invention is to provide an apparatus which can be put to use at the locale of construction, on the way to or from a building site and/or at the locus of storage or availability of the constituents.

Another object of the invention is to provide the apparatus with novel and improved means for regulating the rate of discharge of aerated building material.

A further object of the invention is to provide an apparatus whose dimensions need not exceed those of conventional apparatus but which is capable of furnishing aerated building material at the same rate as a conventional apparatus having the same size and similar or identical energy requirements.

An additional object of the invention is to provde the apparatus with novel and improved means for ensuring adequate admission of air into the mixture of solid and liquid constituents in a small area and in such a way that the mixture is homogenized to an extent not achievable or not readily achievable in heretofore known apparatus for continuous preparation of mortar or the like.

Another object of the invention is to provide an apparatus which not only ensures thorough intermixing of solid and liquid constituents but also a highly uniform distribution of large quantities of entrapped air in the mixture.

A further object of the invention is to provide an apparatus of the above outlined character which is constructed and assembled in such a way that its outlet ceases to discharge the mixture as soon as the constituent-admitting and mixing operations are completed or interrupted.

Another object of the invention is to provide the apparatus with novel and improved means for effecting highly satisfactory intermixing of solid and liquid constituents simultaneously with uniform distribution of air in the mixture.

One feature of the invention resides in the provision of a method of converting flowable solid and liquid constituents, such as cement and water, into mortar or analogous building materials. The method comprises the steps of admitting metered quantities of solid constituent into a first portion of a predetermined path (e.g., a horizontal or substantially horizontal path which is defined by an elongated cylindrical or substantially cylindrical housing) and conveying the admitted solid constituent in a predetermined direction at a given speed, admitting the liquid constituent into a second portion of the path downstream of the first portion, mixing the solid and liquid constituents in the path in the presence of air, and decelerating the constituents in the course of the mixing step to a speed which is less than the given speed. The decelerating step can be carried out in the second portion of the path, in a third portion which is located downstream of the second portion, or in the second portion as well as in the third portion.

The decelerating step can include accumulating a supply of the mixture in a predetermined portion of the path and advancing the mixture from the supply and beyond the predetermined portion of the path at least substantially at the rate at which the predetermined portion receives solid and liquid constituents so that the quantity of mixture in the predetermined portion of the path remains at least substantially unchanged. The predetermined portion can include the second portion, it can be located downstream of the second portion, or it can include the second portion as well as an additional portion of the path.

As a rule, or at least in many instances, the liquid constituent is or contains water.

The conveying step can include subjecting the liquid and/or solid constituent to the action of a first force acting in the predetermined direction, and the decelerating step can include subjecting the mixture to the action of a lesser second force acting counter to the predetermined direction. This can be achieved by utilizing paddles, blades, vanes, threads and/or analogous advancing means for moving the solid constituent and the mixture in the predetermined direction, and by using additional paddles, blades, vanes or like elements which tend to move the mixture in the opposite direction so as to ensure that the differential between the two speeds suffices to guarantee the mixing of successive increments or unit lengths of the mixture for intervals of predetermined duration, e.g., for intervals of at least twenty seconds.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

EMBODIMENTS

Figure 1:
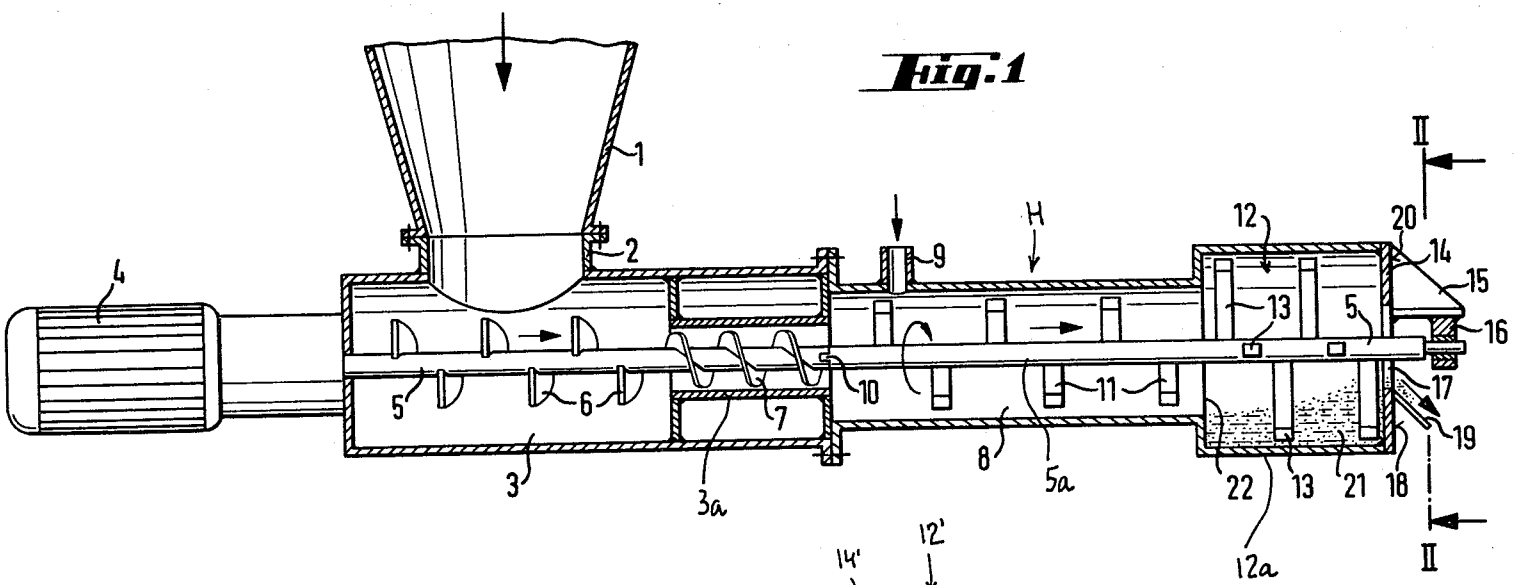
FIG. 1 is a central longitudinal sectional view of an apparatus which embodies one form of the invention.

The apparatus of FIG. 1 can constitute a stationary aggregate or a unit which is installed on a truck so that it can be operated during transport from storage to the locale of use or from one building site to another. The apparatus comprises a substantially horizontal elongated housing H including a dispersing or loosening chamber 3 which receives a solid constituent (such as pulverulent cement) from a funnel 1 by way of a short connecting conduit 2. The left-hand end portion of the housing H, as viewed in FIG. 1, is connected with the casing of a prime mover 4, here shown as an electric motor, whose horizontal output shaft 5 extends into the housing and carries a set of axially spaced blades or analogous loosening elements 6 which rotate in the chamber 3 so as to agitate its contents and thereby prevent caking or agglomeration of solid constituent in regions adjacent to the internal surface of the respective portion of the housing H.

The discharge end of the chamber 3 communicates with the intake of a smaller-diameter metering chamber **3*a* which spacedly surrounds the shaft 5 and serves to deliver metered quantities of solid constituent to an auxiliary or preliminary mixing device or unit 8. The section 3*a* of the housing H contains a feed screw 7 which is driven by the shaft 5 and continuously supplies to the device 8 a stream of solid constituent at a rate which is determined by the diameter of the chamber 3*a* and the speed of the shaft 5. The shaft 5 has a separable extension 5*a* which extends axially through and beyond the auxiliary mixing device 8 and is connected with the main portion of the shaft 5 by a suitable coupling 10 which, when disengaged, allows the device 8 to pivot with reference to the chamber 3*a* for the purpose of cleaning the mixing device 8 and/or for storage. Reference may be had to the aforementioned U.S. Pat. No. 4,223,996. It will be noted that the inner diameter of the chamber 3*a* is a small fraction of the inner diameter of the loosening chamber 3 and/or the inner diameter of the auxiliary mixing device 8**.

The housing H (which defines a substantially horizontal elongated path for the constituents of the mixture) is formed with an inlet 9 for admission of metered quantities of liquid constituent. This inlet is a pipe which contains a suitable valve (refer to the aforementioned U.S. Pat. No. 4,223,996) and admits metered quantities of liquid constituent (normally water or a liquid which contains water) into the upper portion and close to the inlet of the auxiliary mixing device 8.

The auxiliary mixing device 8 is a tubular body which forms a separable part of the housing H and confines a series of radially or substantially radially disposed paddles, blades, vanes or analogous agitating or mixing elements 11 receiving motion from the extension **5*a* of the shaft 5 and serving to effect at least some preliminary mixing of solid and liquid constituents which advance in a direction to the right, as viewed in the drawing, under the action of the feed screw 7, i.e., under the action of the means for supplying the solid constituent into that portion of the path which is defined by the chamber 3*a* and the auxiliary mixing device 8. If desired, the agitating elements 11 in the mixing device 8 can be configurated and/or mounted in such a way that they not only effect a more or less pronounced agitation or mixing of the solid and liquid constituents but that they also contribute to conveying action of the feed screw 7 in the chamber 3*a***.

In accordance with a feature of the invention, the apparatus further comprises a mixing chamber or mixing head 12 which is disposed downstream and can form an integral part of the preliminary or auxiliary mixing device 8. The mixing chamber 12 comprises a tubular (preferably cylindrical) section 12*a* whose diameter exceeds that of the device 8 and whose axial length may be a small fraction (e.g., one-third) of the axial length of the device 8. The inner diameter of the chamber 12 can exceed the inner diameter of the device 8 by approximately 60 percent. The section 12*a* is coaxial with the device 8, and the extension 5*a* of the shaft 5 extends through and beyond the chamber 12. In the interior of the chamber 12, the extension 5*a* of the shaft 5 carries a mixing means in the form of a set of agitating and/or advancing or conveying elements 13 which receive torque from the extension 5*a* and serve to effect additional and preferably thorough as well as relatively long-lasting intermixing of solid and liquid constituents, namely, of the mass which is formed in the device 8 as a result of admission of liquid constituent via pipe 9 into the continuous stream of solid constituent which is supplied by the feed screw 7. If desired, the agitating elements 13 of the mixing means in the chamber 12 can perform a pure agitating or mixing action, i.e., they can cause batches of the mixture to travel about the axis of the extension 5*a*, especially along the internal surface of the cylindrical section 12*a*. At the same time, the mixture advances toward an outlet 17 which is an aperture provided in the end wall 14 of the chamber 12. This end wall constitutes a decelerating means which prolongs the intervals of dwell of successive increments of the mixture in the cylindrical section 12*a* so that each increment of the mixture remains in longer-lasting contact with the mass of air filling the upper portion of the device 8 as well as the upper portion of the chamber 12. The agitating elements 13 may be similar to or identical with the agitating elements 11 on that portion of the extension 5*a* which extends through the auxiliary mixing device 8.

The end wall 14 can be said to constitute a barrier which impedes the progress of the mixture through the chamber 12 and thereupon through and beyond the outlet 17. It is often preferred to provide a readily separable connection between the section 12*a* and end wall 14 so as to ensure that the interior of the chamber 12 can be readily cleaned and/or inspected. Furthermore, the apparatus can be furnished with one or more spare end walls 14 each of which has an outlet 17 of a different cross-sectional area so that the selected end wall offers a given resistance to advancement of the mixture through and beyond the chamber 12. In this manner, an attendant can select the intensity of mixing action in the chamber 12, i.e., the homogeneousness of the ultimate product as well as the percentage of air which is entrapped in the product as a result of repeated and pronounced agitation of the mixture in the chamber 12 in the presence of air.

The outer side of the end wall 14 is connected with a bracket 15 for a bearing 16 which rotatably supports the front end portion of the extension 5*a*. It goes without saying that the shaft 5 can constitute a one-piece body which extends from the casing of the motor 4 and all the way into the bearing 16 if the auxiliary mixing device 8 is not pivotally secured to the housing portion surrounding the chamber 3*a*.

Figure 2:
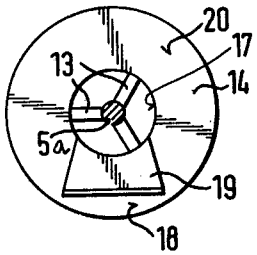
FIG. 2 is an end elevational view as seen in the direction of arrows from the line II—II of FIG. 1.

FIG. 2 shows that the diameter of the outlet 17 is substantially smaller than the inner diameter of the cylindrical section 12*a*, i.e., the cross-sectional area of the chamber 12 greatly exceeds the cross-sectional area of the outlet. The difference is preferably well in excess of 20 percent, e.g., between 22 and 42 and normally between 25 and 30 percent.

If the mixing device 8 and the mixing chamber 12 are non-rotatably secured to the chamber 3*a*, only the lower part 18 of the end wall 14 is determinative of the retarding action of the end wall upon the mixture in the chamber 12. This lower part is provided with a suitably inclined chute 19 along which the exiting mixture slides into the bucket of a crane or into another suitable receptacle. Nevertheless, the end wall 14 further comprises an upper portion 20 which is disposed at a level above the outlet 17 and whose primary purpose is to prevent the circulating mixture from escaping by a route other than via outlet 17.

The length of the mixing chamber 12 can be in the range of 30 cm but it can be considerably more, depending on the overall dimensions of the apparatus and on the desired output. All that counts is to ensure that the periods or intervals of dwell of successive increments of the mixture in the chamber 12 are prolonged beyond those periods which would be achieved in the absence of any obstruction or resistance to the flow of mixture from the interior of the chamber 12. The lower portion of the chamber 12 between the inlet 22 and the outlet 17 constitutes a sump 21 which stores a substantially constant supply of intermixed solid and liquid constituents while the surplus of the mixture issues from the housing H via outlet 17. It can be said that the end wall 14 obstructs evacuation of the supply in the sump 21; nevertheless, the rate at which the mixture issues via outlet 17 is at least substantially the same as the rate at which the solid and liquid constituents of the mixture are admitted into the chamber 12. Of course, the volume of the mixture in the chamber 12 increases beyond the combined volume of admitted solid and liquid constituents because the agitating elements 13 promote the penetration of substantial quantities of air into the mixture upstream of the end wall 14.

The diameter of the outlet 17 is substantially smaller than the diameter of the inlet 22 of the mixing chamber 12. Thus, the height of the sump 21 is less in the region of the inlet 22 than in the region of the outlet 17 because the height of the lower portion 18 of the end wall 14 exceeds the height of the lower portion of the annular left-hand end wall of the chamber 12, as viewed in FIG. 1.

The auxiliary mixing device 8 constitutes a desirable and advantageous but optional component of the improved apparatus. Thus, the mixing chamber 12 can be installed immediately adjacent to the outlet of the metering chamber 3*a* and the pipe 9 then admits metered quantities of liquid constituent directly into the interior of the mixing chamber. The aerating effect of the improved apparatus is not appreciably affected by the presence or absence of the auxiliary mixing device 8.

Figure 3:
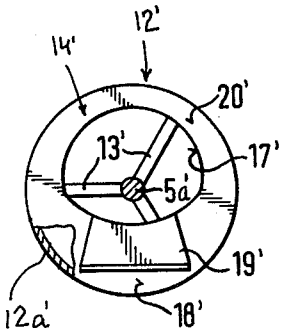
FIG. 3 is a similar end elevational view of a modified apparatus.

FIG. 3 shows that the outlet 17' need not be located centrally of the end wall 14' if the mixing chamber 12' is stationary, i.e., if such chamber does not rotate about the axis of the extension 5*a'*. In this instance, the distance between the lower portion of the tubular section 12*a'* of the chamber 12' and the outlet 17' is greater than the distance between the upper portion of the section 12*a'* and the outlet 17'. Otherwise stated, the height of the ehd wall portion 18' below the outlet 17' exceeds the height of the end wall portion 20' above the outlet 17'. The reference character 13' denotes one of several equally distributed agitating elements in the interior of the chamber 12' In the apparatus which embodies the structure of FIG. 3, the height of that end portion of the sump in the lower portion of the chamber 12' which is adjacent to the end wall 14' is greater than the height of the corresponding portion of the sump 21 shown in FIG. 1. The fact that the height of the end wall portion 20' is less than the height of the end wall portion 20 is of no consequence because the sole function of the end wall portion 20' (the same as that of the end wall portion 20) is to prevent uncontrolled escape of the mixture from the interior of the mixing chamber.

If desired the funnel 1 of FIG. 1 can be installed below a storage bin for concrete or other flowable pulverulent or granular solid constituent which must be admixed to a liquid constituent in order to form mortar, concrete, plaster or a like building material. The housing H is then fixedly or removably installed below the bin.

The main purpose of the mixing chamber 12 or 12' is to increase the percentage of air in the finished product, i.e., the mixing or agitating action of elements 13 in the interior of the mixing chamber is intended to force air into the mixture even though such elements also perform or can perform a desirable mixing action, especially if the auxiliary mixing device 8 is omitted. In the absence of the mixing chamber 12 or 12', the apparatus of FIG. 1 would produce a mixture containing between approximately 6 and 7 percent by volume of entrapped air. In other words, if the chamber 12 or 12' were omitted so that the device 8 would permit the mixture to escape via inlet 22 (which is the outlet of the device 8), the percentage of entrapped air in the finished product would be well below 10 percent. This would be attributable to the fact that such apparatus would be devoid of the improved decelerating means which prolongs the intervals of dwell of successive increments of the mixture in the housing H by the simple expedient of reducing the cross-sectional area of the outlet 17 or 17' to an area which is substantially less than that of the cylindrical section 12*a* or 12*a*' It will be noted that the diameter of the inlet 22 matches the inner diameter of the device 8. The provision of the end wall 14 or 14' or an analogous barrier entails an increase of the percentage of entrapped air from 6–7 percent (in the absence of the mixing chamber 12 or 12') to several times such percentage, namely, to more than 10 percent and normally more than 15 percent (e.g., between 16 and 18 percent), an increase of more than 100 percent.

Experiments with the improved apparatus indicate that the percentage of air in the finished product is incomparably higher than in the absence of the mixing chamber 12 or 12'. For example, a lime-cement mortar for exterior use normally contains between 7 and 8 percent of entrapped air if the mixture is prepared in a conventional apparatus which does not employ an equivalent of the mixing chamber 12 or 12' incorporating or being combined with suitable decelerating means. In the apparatus of the present invention, the content of entrapped air can be raised to between 16 and 17 percent. In the making of mortar for the erection of walls, the percentage of entrapped air can be increased from between 7 and 8 percent (by resorting to a conventional apparatus) to between 14 and 16 percent by the simple expedient of equipping a conventional apparatus with the improved mixing chamber and decelerating means. In the making of a heat-insulating building material, the percentage of entrapped air can be raised from between 10 and 12 percent to between 20 and 22 percent.

In the absence of the mixing chamber 12 or 12', and assuming that the thus modified apparatus of FIG. 1 would employ an auxiliary mixing device 8 having a length of between 55 and 60 cm, each increment of the mixture would dwell in the mixing device 8 for an interval of approximately 10 seconds. As a rule, the quantity of intermixed solid and liquid constituents in the device 8 of such a conventional apparatus is between 6 and 7 liters. By adding the mixing chamber 12 or 12', the period of dwell of each unit length of the mixture in the apparatus of FIG. 1 can be increased to between 30 and 40 seconds, and the quantity of mixture which is subjected to the aerating action is increased to between 16 and 18 liters.

In the absence of the mixing chamber 12 or 12', the height of the stream of intermixed constituents below the agitating elements 11 in the device 8 is between 45 and 50 mm, and the height of the stream which issues via inlet 22 (i.e., outlet of the device 8) is between 15 and 25 mm. The end wall 14 or 14' of the mixing chamber 12 or 12' can increase the height of the material at the discharge end of the sump 21 to approximately 85 mm.

If the diameter of the circular path for the tips of agitating elements 11 in the mixing device 8 is 180 mm, the speed of the tips of such agitating elements, when the extension 5*a* rotates at 272 RPM, is approximately 2.55 meters per second. If the inner diameter of the mixing chamber 12 or 12' is approximately 300 mm and the tips of the agitating elements 13 extend close to the internal surface of the cylindrical section 12*a* or 12*a*', the speed of such tips at the same RPM of 272 is 4.27 meters per second. Such velocity of the tips of agitating elements 13 ensures the establishment of required friction, especially for admixure of requisite quantities of air into the material which is treated in the interior of the mixing chamber. As mentioned above, prolongation of the intervals of dwell of successive increments of the mixture in the chamber 12 or 12' entails a highly pronounced increase (by at least 100 percent) of the quantity of entrapped air in the product which issues via outlet 17 or 17'.

In a conventional apparatus which does not employ the mixing chamber 12 or 12' and the improved decelerating means, the material which is admitted into the device 8 is mixed and advanced toward the outlet primarily in the lowermost part of the casing of the device 8. In the improved apparatus wherein the mixing chamber 12 or 12' establishes a sump for a supply of mixture therein and wherein the inner diameter of the cylindrical section 12 or 12*a*' exceeds the inner diameter of the device 8, the speed of the tips of agitating elements 13 or 13' (which preferably extend close to the internal surface of the section 12*a* or 12*a*') is sufficiently high to ensure that a portion of the material which is treated in the chamber 12 or 12' is lifted above the sump and is thereupon caused to descend back into the supply of material in the sump. This entails a pronounced intensification of the mixing action.

Experiments with a conventional apparatus which embodies the device 8 but does not employ the mixing chamber 12 or 12' indicate that the shape and dimensions of the agitating elements 11 exert a minimal influence upon the quality of the mixing action and no influence at all upon the admission of air into the mixture. On the other hand, the provision of the mixing chamber 12 or 12' and of agitating elements 13 or 13', whose tips orbit at a speed considerably exceeding that of the tips of agitating elements 11 in the device 8, contributes significantly to the quality of the mixing action and especially to an increase of the percentage of air in the finished product. The agitating elements 13 or 13' may constitute conventional paddles, blades, flat pieces of iron with holes therein or analogous agitating components which enhance the admission of air into the mixture in the interior of the section 12*a* or 12*a'*. The advancing or conveying action of the agitating elements 13 or 13' can be negligible or zero. If the elements 13 or 13' are to contribute to transport of the mixture toward and through the outlet 17 or 17', they can be in the form of vanes, paddles or like components which can be twisted in alternate directions so that they perform at least some mixing action in addition to the conveying action in a direction toward the outlet of the mixing chamber. The twisting or wrenching of such agitating elements can be quite pronounced.

Another advantage of the mixing chamber 12 or 12' with a sump for the mixture of solid and liquid constituents is that it allows for longer-lasting and more intensive mixing of the solid and liquid constituents. This is especially desirable when the feed screw 7 fails to deliver the solid constituent at a highly constant rate, i.e., when the rate of admission of solid constituent into the device 8 or directly into the mixing chamber 12 or 12' fluctuates within a certain range. In other words, the sump in the mixing chamber contributes to more satisfactory homogenization of the ultimate product, especially if the solid constituent is not admitted at a highly constant rate. The provision of a sump in the mixing chamber further facilitates the intermixing of basic solid and liquid constituents with additional ingredients or fillers such as fibrous materials, lightweight aggregates or premixed foams.

When making heat-insulating mortar, e.g., insulating mortar with light expanded clay aggregate, the finished product has a liter weight of less than 1.0 after setting. This is accomplished by the provision of the mixing chamber 12 or 12' which causes the percentage of entrapped air in such material to rise by an additional 8 to 10 percent. In contrast to the improved apparatus, the conventional apparatus are not likely to ensure a liter weight of less than 1.0, especially not on a continuous basis and with a requisite degree of reproducibility. Insulating wall mortar with a light expanded clay aggregate (but also other types of mortars for use in the making and/or covering of walls) tend to undergo at least some hardening in the bucket of a crane or another receptacle, e.g., a receptacle which receives mortar from the bucket. As a rule, such setting or hardening must be taken into consideration during mixing in a conventional apparatus. Alternatively, it is necessary to admit additional water into the mixture at the locale of use, i.e., prior to actual building of walls or application of mortar in connection with the erection of walls or the like. It has been found that the tendency of the material which issues from the improved apparatus to harden is greatly reduced because the interval of dwell in the mixing chamber is relatively long so that at least a certain amount of such setting can take place in the interior of the section 12*a* or 12*a'* before the mixture issues via outlet 17 or 17'. Moreover, chemicals or similar additives which are contained in or added to the mixture are much more likely to be fully solubilized and to react with other ingredients of the mixture owing to longer intervals of dwell of constituents in the apparatus and to more intensive agitating action. In other words, the desired effect of such chemicals is more pronounced because they have a longer period of time to react with other ingredients prior to actual use of the finished product.

An additional important advantage of the improved apparatus is that the end wall 14 or 14' ensures the retention of a certain supply of mixture in the sump which is defined by the lower portion of the section 12*a* or 12*a'*. Thus, when the motor 4 is started again, the apparatus can deliver a continuous stream of ready-to-use mixture practically immediately. Moreover, the lower portion 18 or 18' of the end wall 14 or 14' reduces the likelihood of escape of batches of mixture from the chamber 12 or 12' subsequent to stoppage of the motor 4. This is desirable and advantageous because the attendant can prevent the mixture from descending onto the ground upon removal of the bucket which normally receives the mixture from the mixing chamber 12 or 12' via outlet 17 or 17'. A conventional apparatus is highly likely to continue with the discharge of a stream of mixture after the agitating elements are brought to a halt because the height of the stream at the outlet of such conventional apparatus is reduced to zero only after elapse of a certain interval following stoppage of the motor which drives the rotary parts. This is highly undesirable, not only because the escaping mixture is lost for use in the erection of walls or the like but also because the escaped material contaminates the surrounding area. It has been found that the end wall 14 or 14' is capable of interrupting the discharge of mortar as soon as the motor 4 is arrested, e.g., preparatory to or simultaneously with removal of a filled bucket or an analogous receptacle from the region of the outlet 17 or 17'. This will be readily appreciated since the sump in the chamber 12 or 12' can store the material which remains in the chamber 12 or 12' subsequent to stoppage of the motor 4.

As already explained above, the improved chamber 12 or 12' can be attached directly to the chamber 3*a* and the device 8 is then omitted. The chamber 12 or 12' can be designed as an attachment for use in conventional apparatus, such as the apparatus which is disclosed in the aforementioned U.S. Pat. No. 4,223,996. All that is necessary is to detach the device 8 and to attach the mixing chamber 12 or 12' directly to the discharge end of the chamber 3*a* (it being assumed that the chamber 12 or 12' is separable from the device 8 and that the device 8 is separable from the chamber 3*a*). As a rule, the housing H defines a substantially horizontal path for the solid constituent and for the mixture of solid and liquid constituents, i.e., the axis of the shaft 5 and its extension 5*a* or 5*a'* is normally horizontal. However, it is equally within the purview of the invention to promote the advancement of solid constituent, liquid constituent and/or the mixture of such constituents by providing a somewhat inclined path, especially a path which slopes downwardly toward the outlet 17 or 17'. All that is necessary is to ensure that, in spite of its inclination (downwardly and in a direction to the right, as viewed in FIG. 1), the mixing chamber is provided with an end wall whose lower portion 18 or 18' is sufficiently high to guarantee the establishment and maintenance of an adequate supply of mixture in the sump below the extension 5*a* or 5*a'*. For example, the axis of the shaft 5 and its extension 5*a* or 5*a'* can slope by as much or even in excess of 10 degrees, and the end wall 14 or 14' can remain in a plane which is normal to such axis. This may necessitate an increase in the height of the portion 18 or 18' of the end wall 14 or 14'.

The length of the mixing chamber 12 or 12' can be increased if the manufacturer wishes to ensure that the mixture will remain therein for relatively long intervals of time and/or if the apparatus is to supply relatively large quantities of mixture per unit of time. As a rule, lengthening of the mixing chamber will contribute to a more satisfactory aerating action, i.e., it will ensure the entrapment of a higher percentage of air in the material which issues via the outlet opening of the mixing chamber. However, the length of the mixing chamber cannot be increased at will without appreciable increase of energy requirements in order to ensure adequate transport of material through the housing and adequate agitation in the device 8 and/or mixing chamber 12 or 12'. The mixing chamber will normally comprise a stationary cylindrical section 12*a* or 12*a'*, especially if the remaining parts of the housing H are stationary, i.e., if such parts do not rotate about the axis of the shaft 5. However, it is within the spirit of the invention to employ a rotary housing or an apparatus wherein at least the mixing chamber rotates when the apparatus is in actual use.

The diameter of the mixing chamber 12 or 12' and/or the diameter of the device 8 need not be constant from end to end. For example, the mixing device 8 can comprise a tubular section whose diameter increases or decreases in a direction toward the inlet 22 of the chamber 12 or 12'.

The damming action of the end wall or barrier 14 ensures that a constant supply of material remains in the sump 21 as well as that the material in the chamber 12 is subjected to protracted mixing and aerating action. Nevertheless, the apparatus furnishes a continuous stream of the mixture to a bucket or a like receptacle which is not shown in FIGS. 1 to 3. The agitating elements 11 and 13 penetrate into and are withdrawn from the mass of material in the mixing chamber 12 and device 8 because neither the device 8 nor the chamber 12 is filled to capacity. Such repeated penetration of elements 11 and 13 into and their withdrawal from the mass of material in the housing H enhances the introduction of large quantities of air into the material which is about to issue via outlet 17.

Figure 4:
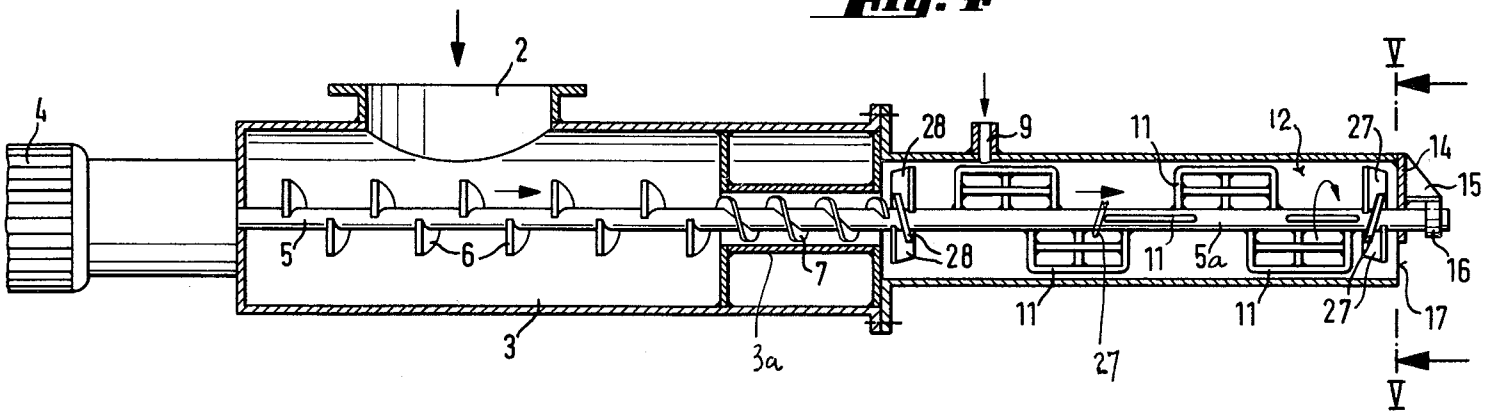
FIG. 4 is a fragmentary central longitudinal vertical sectional view of a third apparatus.
Figure 5:
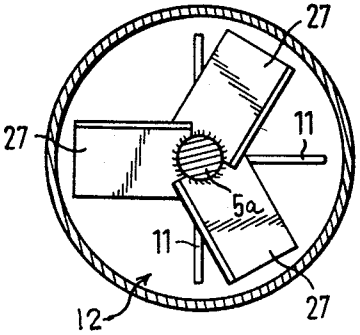
FIG. 5 is an enlarged end elevational view as seen in the direction of arrows from the line V—V of FIG. 4.

FIGS. 4 and 5 illustrate a portion of a modified apparatus. All such parts of the modified apparatus which are identical with or clearly analogous to the corresponding parts of the apparatus shown in FIGS. 1 and 2 are denoted by similar reference characters. That end portion of the extension 5*a* of the shaft 5 which is adjacent to the outlet of the mixing chamber 12 supports a set of three agitating elements 27 in the form of paddles, vanes or blades (see particularly FIG. 5) which are designed to generate a force acting in a direction counter to the direction of travel of the mixture toward the outlet 17. Such force does not suffice to actually interrupt the flow of mixture toward the outlet 17 but the elements 27 constitute a barrier or decelerating means which ensures prolonged dwell of the material in the chamber 12 and hence the admission of large quantities of air into the mixture which advances from the chamber 3*a* toward the outlet 17. The apparatus of FIGS. 4 and 5 comprises three equidistant blades 27 which are secured to and share the angular movements of the extension 5*a*.

The mixing chamber 12 further accommodates a set of vanes or blades 28 which are secured to the extension 5*a* in the region of the inlet of the chamber 12 and whose inclination is such that they tend to advance the mixture toward the outlet 17. The force which the blades 28 apply to the mixture in order to advance the mixture toward the outlet opening 17 can match the force with which the blades 27 tend to advance the mixture in the opposite direction, i.e., away from the outlet 17 and back into the interior of the mixing chamber 12. The agitating elements 11 between the blades 27 and 28 are preferably neutral, insofar as the transport of mortar toward the outlet 17 is concerned, so that the material is urged in a direction toward the outlet 17 with a force which is supplied by the feed screw 7 or analogous means for supplying metered quantities of solid constituent into the mixing chamber. The agitating elements 11 may constitute grates or lattice-like structures with a plurality of relatively large or small openings. Such structures can be disposed in planes including the axis of the extension 5*a* so that the advancing or conveying action of the mixing means 11 upon the mixture in the chamber 12 is negligible or nil.

The blades 27 of the barrier shown in FIG. 4 can carry suitable protuberances which promote the penetration of air into the mixture upstream of the outlet 17. Such protuberances can be in the form of plates, blades, pins, studs or the like. Note the protuberances 6 in FIG. 3 of U.S. Pat. No. 4,223,996 which is incorporated herein by reference. The protuberances can be said to constitute auxiliary mixing means which are provided on the barrier and, in addition to enhancing the aeration of the product, also promote the mixing of solid and liquid constituents.

Irrespective of whether the blades 27 do or do not carry protuberances or analogous auxiliary mixing means, such blades evidently contribute to the mixing action in the chamber 12 and also to the aerating action with the result that the percentage of entrapped air in the finished product is at least twice that of air in mortars which are produced by resorting to conventional apparatus.

It will be appreciated that the provision of blades 27 on the extension 5*a* is quite contrary to heretofore known proposals and practices, namely, to ensure practically or substantially unimpeded progress of materials toward the outlet of the apparatus. In this embodiment of the present invention, the blades 27 actively seek to advance the material in a direction away from the outlet 17, i.e., back into the interior of the chamber 12. The force which is generated by the blades 27 not only ensures the accumulation of a constant supply of material in the sump of the chamber 12 but further causes the material to perform movements which contribute to entrapment of larger quantities of air. In other words, the blades 27 generate movements within the mass of material in the chamber 12 such as are totally absent in heretofore known apparatus wherein the material is supposed to leave the housing as rapidly as possible. The admission of a high percentage of air not only contributes to more satisfactory thermal insulating properties of the product but also ensures that the weight of the product per unit volume is less than heretofore.

Since the cost of mortar, concrete, plaster or like materials is often very high, any savings which are achieved by increasing the volume contribute to a significant reduction of the cost of building or repair work. At the same time, the lightweight building material exhibits superior thermal insulating properties.

The mounting of the barrier or barriers on the extension 5*a* of the shaft 5 is desirable and advantageous because such parts can be readily cleaned upon detachment of the extension 5a from the main portion of the shaft 5.

Figure 6:
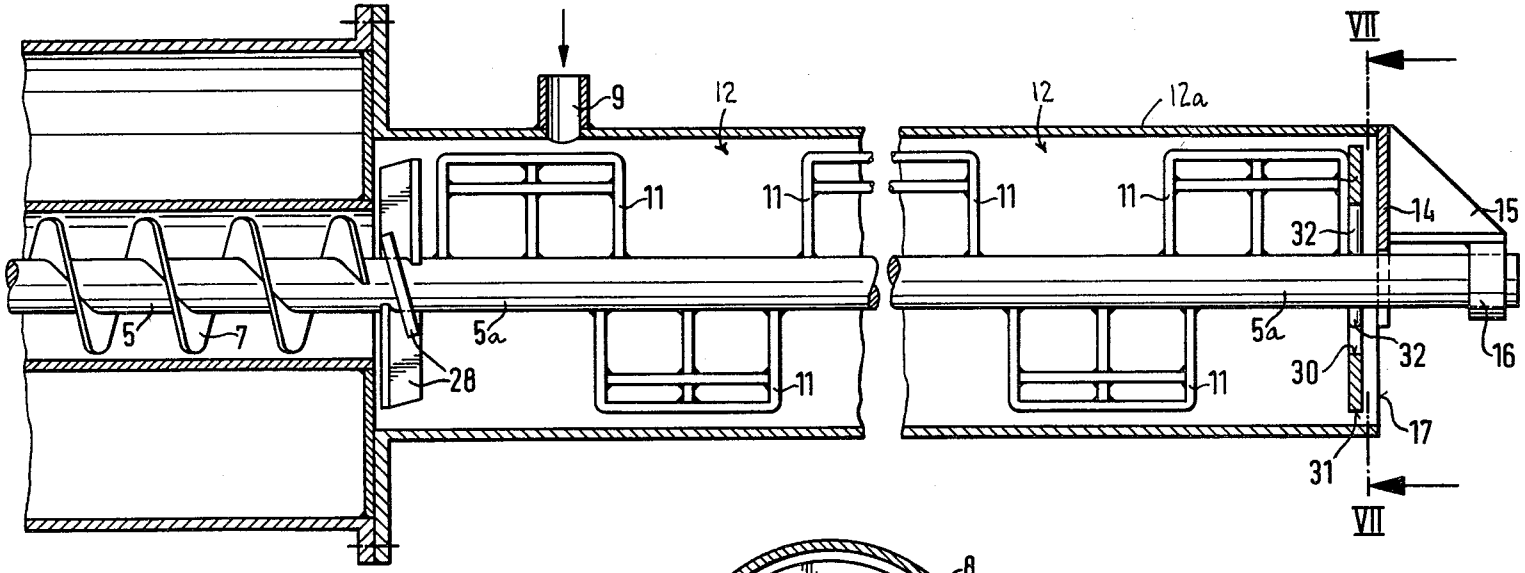
FIG. 6 is a fragmentary central longitudinal vertical sectional view of a fourth apparatus.
Figure 7:
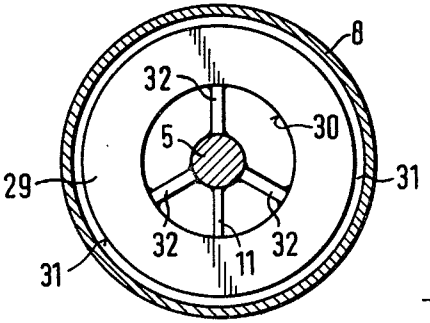
FIG. 7 is an end elevational view as seen in the direction of arrows from the line VII—VII of FIG. 6.

FIGS. 6 and 7 show a portion of a further apparatus which constitutes a modification of the apparatus shown in FIGS. 4 and 5. The extension 5a of the shaft 5 carries a disc-, ring- or washer-like annular element 29 which is secured to the extension 5a by three equidistant radially extending spokes 32 (see FIG. 7) and which is spaced apart from the periphery of the extension 5a as well as from the section 12a of the mixing chamber 12. This results in the formation of one or more openings at the periphery of as well as within the annular element 29 to allow for the flow of mortar from the section 12a. The outer opening is a ring-shaped opening 31 which is adjacent to the peripheral surface of the element 29, and the inner opening 30 is divided into three segments by the spokes 32.

As shown in FIG. 6, one of the agitating elements 11 is connected with the annular element 29 to enhance the stability or reliability of connection between the element 29 and the extension 5a. Such connection between the extension 5a and the element 29 via agitating element 11 can be provided in addition to or in lieu of the spokes 32. The left-hand end of the mixing chamber 12 shown in FIG. 6 also carries a set of three blades 28 which perform the same function as the similarly referenced blades in the apparatus of FIG. 4. The agitating elements 11 which are shown in FIG. 6 are preferably neutral, i.e., they stir the mixture but do not contribute to advancement of the mixture toward the outlet.

The entire intermediate portion of the chamber 12 shown in FIG. 4 or 6 can constitute or comprise a sump for the storage of a certain supply of mortar upstream of the outlet. The agitating elements 11 ensure the introduction of large quantities of air into the mixture which is agitated between the blades 27, 28 of FIG. 4 or between the blades 28 and annular element 29 of FIG. 6. As mentioned above, the utilization of grate-, lattice- or grid-shaped agitating elements 11 ensures the introduction of large quantities of air into the mixture in the median portion of the mixing chamber 12 shown in FIG. 4 or 6.

The ring- or disc-shaped annular element 29 or an analogous barrier in the chamber 12 can also carry one or more protuberances for the purpose of enhancing its mixing and aerating action. Reference may be had to FIG. 3 of the aforementioned U.S. Pat. No. 4,223,996 which shows plate-like protuberances on a feed screw driven by a shaft corresponding to shaft 5 of the apparatus shown in FIGS. 6 and 7.

Figure 8:
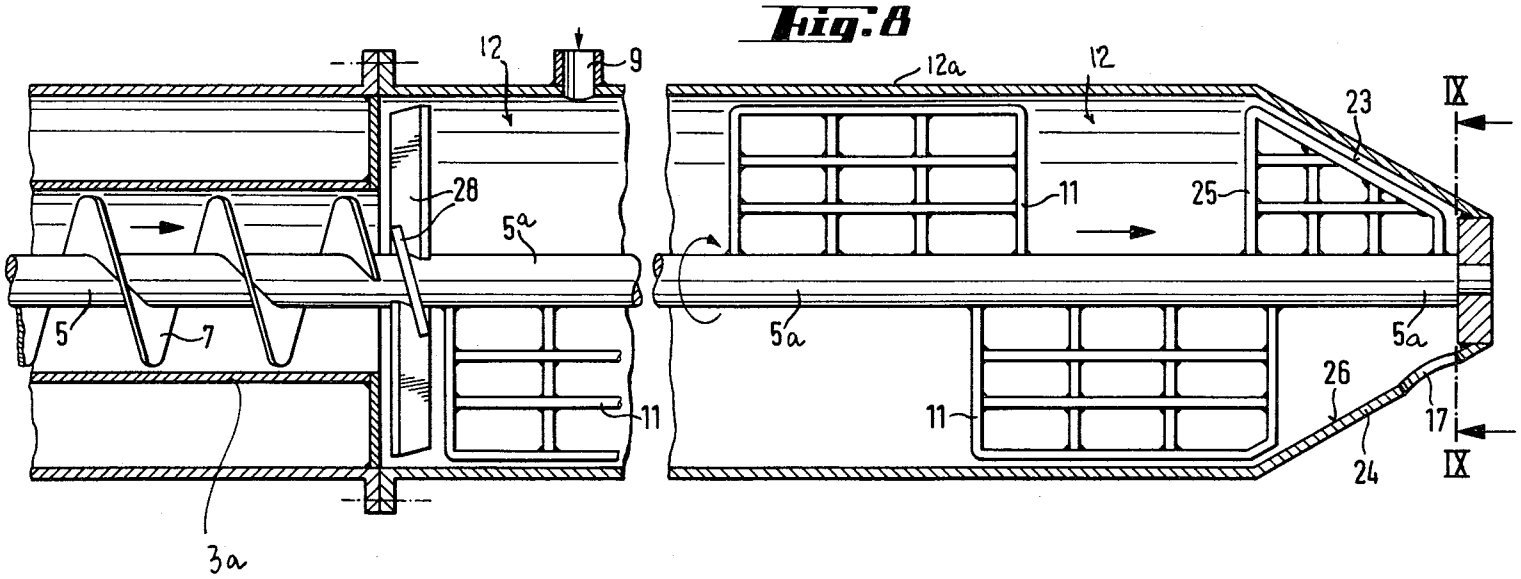
FIG. 8 is a fragmentary central longitudinal vertical sectional view of a fifth apparatus.
Figure 9:
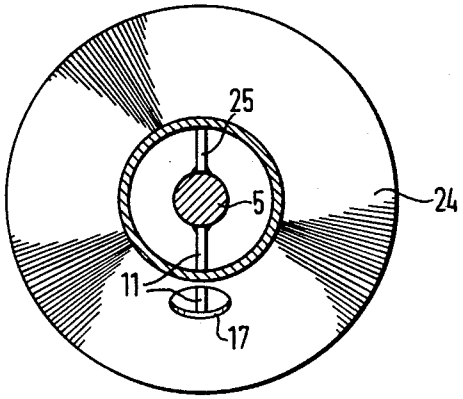
FIG. 9 is a fragmentary end elevational view as seen in the direction of arrows from the line IX—IX of FIG. 8.

In the embodiment of FIGS. 8 and 9, the mixing chamber 12 comprises a cylindrical section 12a and a hollow frustoconical section 24 whose diameter decreases in a direction away from the section 12a and which is formed with an outlet 17 in the form of a circular or substantially circular aperture located at a level below the extension 5a. The section 24 can be said to constitute a barrier or decelerating means which opposes free outflow of material from the mixing chamber 12 and thereby prolongs the periods of dwell of successive increments of the mixture in the chamber 12. It can also be said that the section 24 constitutes a constriction which effects a gradual reduction of the inner diameter of the chamber 12 in a direction from the chamber 3a toward the outlet 17. The outlet 17 can be formed at a desired level above the lowermost portion of the section 12a, i.e., the portion 26 of the section 24 can ensure the accumulation of a certain supply of mortar in the sump which is constituted by the lower part of the chamber 12. A part of the portion 26 slopes upwardly from the tubular section 12a toward the outlet 17. The section 24 can be constructed as a discrete part which is separable from the section 12a and which can be replaced with a frustoconical section having a different length, slope and/or a differently dimensioned outlet 17. This renders it possible to vary the quantity of material which accumulates in the sump of the chamber 12 and/or the periods of dwell of successive increments of the mixture in the sections 12a and 24.

FIG. 8 shows that one of the agitating elements in the chamber 12, namely, the agitating element 25, is installed in the interior of the section 24 and has an outer portion 23 whose slope conforms to that of the internal surface of the section 24 and which is closely adjacent to such internal surface. The agitating element 25 contributes to introduction of air into the mixture which is about to issue from the chamber 12, i.e., there is a final injection of air immediately before the product issues via outlet 17 to descend into a bucket or the like.

The apparatus of FIGS. 8 and 9 can be modified by replacing the section 24 with a section which is partly cylindrical and partly conical, i.e., the upper part of the section 24 can be cylindrical and can constitute an extension of the section 12a, and the lower part of the section 24 can constitute one-half of a conical frustum so that the outlet 17 is located at a desired level above the lowermost portion of the section 12a.

It will be noted that the decelerating means or barriers of the apparatus shown in FIGS. 1–3 and 8–9 are stationary whereas the apparatus of FIGS. 4 to 7 employ rotary barriers.

The parts 8 and 12 of the apparatus shown in FIG. 1 can be said to constitute a relatively long composite mixing chamber wherein the diameter of the section 12 exceeds the diameter of the device 8. The sections 12a and 24 of FIG. 8 constitute parts of a different mixing chamber wherein the diameter of the section (24) which is nearer to the outlet 17 or which defines the outlet decreases in a direction away from the larger-diameter section 12a. In other words, at least a portion of the mixing chamber shown in FIG. 8 has a smaller diameter in close or immediate proximity of the outlet than in the region of the feed screw 7. The diameter of the mixing chamber 12 shown in FIG. 4 or 6 is constant from end to end. An advantage of mixing chambers which are shown in FIGS. 4 and 6 is that they can be made of readily available tubular metallic stock. Moreover, it is more convenient and less time-consuming to clean a mixing chamber whose diameter is constant from end to end. As mentioned above, the mixing chamber is or can be separated from the remaining parts of the housing to allow for convenient cleaning of its interior.

That portion of the conical section 24 which is disposed between the cylindrical section 12a and the outlet 17 can be said to perform a function similar to that of the blades 27 in the apparatus of FIGS. 4 and 5. Thus, the just mentioned portion of the section 24 opposes the flow of material toward the outlet 17 and actually tends to induce the material to flow in a direction away from the outlet.

It has been found that the improved apparatus operates highly satisfactorily when the mixing chamber is filled to more than 50 percent of its capacity. The mixing chamber is preferably filled to more than 60 percent of capacity and even more advantageously to over 70 percent of capacity. The space requirements of the extension 5*a* or 5*a*′ and of agitating elements in the mixing chamber should be taken into consideration, i.e., the volume taken up by such parts should be deducted from the capacity of the chamber 12 or 12′ prior to determination of the extent to which such chamber is to be filled with a mixture of solid and liquid constituents. It was also ascertained that the mixing chamber should not be filled to capacity and that the volume of the mixture should not exceed 90 percent of the capacity of the chamber. In other words, at least 10 percent of such volume should remain empty, for example, to ensure continuous admission of air which is to be intermixed with the material in the mixing chamber. By maintaining the contents of the chamber between 50 and 90 percent of the volume of the mixing chamber, one can ensure highly satisfactory mixing of the constituents as well as highly satisfactory enrichment of the mixture with entrapped air.

It was further found that the period of dwell of each increment of material in the chamber 12 or 12′ should preferably exceed 20 seconds and more preferably 30 seconds. In fact, the apparatus which is shown in FIGS. 8 and 9 is preferably provided with a frustoconical section 24 which ensures that the material remains in the chamber 12 for at least 40 seconds and preferably longer than 40 seconds. However, such relatively long intervals or periods of dwell are not only achievable but also desirable in other embodiments of the improved apparatus. The speed of the tips of agitating elements in the mixing chamber can be and preferably is between 2 and 3 meters per second, most preferably approximately 2.5 meters per second. This holds especially true for the agitating elements in the mixing chambers of FIGS. 4 to 9. However, the speed of the tips of agitating elements in the mixing chamber cannot be increased or reduced totally at will because this would or could entail a reduction of the percentage of air in the ultimate product.

The improved apparatus is susceptible of many additional modifications without departing from the spirit of the invention. For example, and referring again to FIG. 4, the apparatus can comprise two or more barriers which are spaced apart from each other, as considered in the axial direction of the shaft 5, i.e., in the axial direction of the extension 5*a*. FIG. 4 shows one of a second set of blades 27 whose inclination is similar to that of the blades 27 next to the outlet 17 and which are disposed substantially in the center of the mixing chamber 12. The exact configuration of the barriers is of no consequence; all that counts is to ensure that each barrier contributes to retention of the material in the chamber 12 or 12′ for relatively long intervals of time. The second barrier 27 of FIG. 4 is but need not be connected to the nearest agitating element 11; such connection with the agitating element 11 is desirable for the aforementioned reasons, i.e., the barrier is much more likely to share all angular movements of the extension 5*a*, i.e., to overcome pronounced resistance which the material in the chamber 12 of FIG. 4 offers to rotation of the extension 5*a* and of the parts which are mounted thereon.

Another embodiment of the invention contemplates the provision of agitating elements 11 and/or 13 or analogous agitating elements which not only mix the constituents in the chamber 12 or 12′ but also perform a retarding or decelerating action, i.e., which act not unlike barriers and prolong the intervals of dwell of material in the mixing chamber. This can be achieved by utilizing agitating elements 11 and/or 13 in the form of blades which agitate the material in the mixing chamber and also oppose unobstructed progress of such material toward the outlet of the mixing chamber. Some or all of the agitating elements 13 and/or 11 may constitute bodies which act in part as blades or vanes and in part as neutral agitating means.

It is equally within the purview of the invention to lengthen the mixing chamber to such an extent that the barrier or the decelerating means is simply the internal surface of the mixing chamber. In other words, the length of the mixing chamber may be such that frictional engagement between the internal surface of the chamber and the material which advances toward the outlet suffices to ensure a protracted period of dwell of the material in the mixing chamber. Such relatively long mixing chamber can be used without any agitating elements or with agitating elements of such size and/or shape that they merely promote the penetration of air into the mixture and/or enhance the homogeneousness of the mixture but do not oppose the progress of the mixture toward the outlet. A relatively long mixing chamber which does not contain any discrete agitating elements or which contains a relatively small number of such elements can be made to rotate about its axis to thus ensure a predictable and thorough mixing and aerating action. It has been found that such apparatus also ensure highly satisfactory introduction or entrapment of large quantities of air, especially if one adheres to the aforediscussed ranges of speeds of agitating elements of the mixing means as well as to the provision that the mixing chamber be filled to more than 50 percent but less than 90 percent of its capacity.

The present invention constitutes a radical departure from conventional methods and apparatus for the preparation of mortar or the like. Heretofore, it was considered advisable and necessary to ensure that the progress of material which is caused to pass through the apparatus be impeded as little as possible, i.e., it was considered desirable and advantageous to ensure smooth and continuous transport of the material all the way from the locus of admission of various constituents to the outlet. The primary purpose of presently known apparatus is to ensure proper intermixing of solid and liquid constituents because, as a rule, the solid constituent is furnished in a form or state which renders it rather unlikely that such constituent would agglomerate upstream of the locus of contact with the liquid constituent. In contrast to heretofore known proposals and practices, the present invention provides for intentional retardation of the progress of materials in a certain portion or in certain portions of the apparatus with the unexpected result that this contributes to a surprisingly pronounced increase of the percentage of air in the finished product in addition to the fact that the ultimate product is one of more satisfactory homogeneousness.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for making mortar and analogous building materials comprising:

(a) a housing defining a mixing chamber which communicates with a source of air;

(b) admitting means for supplying solid and liquid constituents of a building material to a first section of said mixing chamber;

(c) mixing and advancing means for forming an air-containing mixture of the solid and liquid constituents and for advancing the mixture towards a second section of said mixing chamber; and (d) impeding means for impeding discharge of the mixture from said housing and causing accumulation of the mixture in said second section to thereby permit additional air to be mixed into the mixture, said housing having a discharge opening connecting said mixing chamber with the exterior of said housing, and said mixing and advancing means being arranged to discharge the mixture through said discharge opening against the action of said impeding means at a rate such that an air space is substantially continuously maintained in said second section, said housing being devoid of driven means for assisting said mixing and advancing means in the discharge of the mixture through said discharge opening to thereby prevent the action of said impeding means from being nullified.

2. The apparatus of claim 1, wherein said impeding means is located in the region of said opening.

3. The apparatus of claim 2, wherein said chamber has a predetermined cross-sectional area and said housing includes a portion forming part of said impeding means and defining said opening, the cross-sectional area of said opening being less than said predetermined cross-sectional area.

4. The apparatus of claim 3, wherein said predetermined cross-sectional area exceeds the cross-sectional area of said opening by at least 20 percent.

5. The apparatus of claim 4, wherein said predetermined cross-sectional area exceeds the cross-sectional area of said opening by between 22 and 42 percent.

6. The apparatus of claim 5, wherein said predetermined cross-sectional area exceeds the cross-sectional area of said opening by between 25 and 30 percent.

7. The apparatus of claim 1, wherein said housing includes a hollow cylinder.

8. The apparatus of claim 1, wherein said housing is stationary and includes a tubular section as well as an end wall which is provided with said opening, said tubular section having a lowermost portion distant from and an uppermost portion nearer to said opening.

9. The apparatus of claim 8, wherein said tubular section is at least substantially horizontal.

10. The apparatus of claim 1, wherein said impeding means includes a removable barrier provided in said chamber in the region of said outlet.

11. The apparatus of claim 1, wherein said chamber has an inlet for the solid constituent and the cross-sectional area of said inlet exceeds the cross-sectional area of said opening.

12. The apparatus of claim 1, further comprising an auxiliary mixing device in said chamber adjacent to said admitting means.

13. The apparatus of claim 1, wherein said chamber has an inlet and said mixing and advancing means includes conveying means arranged to deliver metered quantities of the solid constituent directly into said inlet.

14. The apparatus of claim 1, wherein said mixing and advancing means includes a motor-driven shaft extending into said chamber, and agitating means receiving motion from said shaft.

15. The apparatus of claim 1, wherein said impeding means forms part of said housing and constitutes a constriction in the region of said opening.

16. The apparatus of claim 15, wherein said housing includes a substantially tubular section receiving said constituents and the constriction includes a hollow conical section having a portion disposed between said opening and said tubular section and tapering in a direction toward said opening.

17. The apparatus of claim 16, wherein said mixing and advancing means comprises at least one rotary agitating element within the confines of said conical section, said agitating element having a portion adjacent to and at least substantially conforming to the slope of the internal surface of said conical section.

18. The apparatus of claim 16, wherein said conical section includes a lower part having a portion sloping upwardly from said tubular section toward said opening.

19. The apparatus of claim 16, wherein said conical section includes a lower portion sloping upwardly in the region of said opening.

20. The apparatus of claim 1, wherein said mixing and advancing means comprises a driven shaft extending into said mixing, chamber, and at least one agitating element secured to and receiving motion from said shaft, said impeding means comprising at least one barrier secured to and rotating with said shaft in said mixing chamber.

21. The apparatus of claim 20, wherein said housing comprises a tubular section surrounding said barrier, said barrier and said tubular section defining at least one opening for the passage of the mixture.

22. The apparatus of claim 20, wherein said barrier and said shaft define at least one opening for the passage of the mixture.

23. The apparatus of claim 20, wherein said barrier is a disk.

24. The apparatus of claim 20, wherein said barrier is a ring.

25. The apparatus of claim 20, wherein said barrier includes at least one protuberance which promotes the penetration of air into the mixture in response to rotation of said shaft.

26. The apparatus of claim 20, wherein said barrier includes auxiliary mixing means for promoting the intermixing of solid and liquid constituents in said chamber in response to rotation of said shaft.

27. The apparatus of claim 1, wherein said mixing and advancing means comprises a driven shaft extending into said chamber, and at least one agitating element secured to and rotating with said shaft, said impeding means comprising at least one component receiving torque from said shaft and arranged to impede the progress of the mixture toward said opening in response to rotation of said shaft.

28. The apparatus of claim 27, wherein said component includes at least one blade.

29. The apparatus of claim 27, wherein said mixing and advancing means includes means for conveying the solid constituent into said chamber with a first force, and means mounted on said shaft and arranged to advance the mixture in said chamber with a second force, said component including at least one blade secured to said shaft and arranged to oppose the progress of the mixture with a third force at least approximating said second force so that said first force is effective to advance the mixture.

30. The apparatus of claim 29, wherein said means for conveying the solid constituent comprises a rotary feed screw.

31. The apparatus of claim 29, wherein said chamber has an inlet for reception of the solid constituent and said mixing and advancing means includes at least one blade adjacent to said inlet, the blade of said component being adjacent to said opening and said mixing and advancing means further comprising at least one agitating element secured to said shaft and disposed between said blades.

32. The apparatus of claim 31, wherein said agitating element includes at least one apertured member which does not appreciably promote the progress of the mixture toward said opening.

33. The apparatus of claim 32, wherein said apertured member is a grate.

34. The apparatus of claim 1, wherein said chamber has an inlet remote from said opening and arranged to receive the solid constituent, the cross-sectional area of said chamber being at least substantially constant intermediate said inlet and said opening.

35. The apparatus of claim 1, wherein said chamber has an inlet arranged to receive the solid constituent, said chamber having one section of substantially constant cross-sectional area adjacent to said inlet, and another section of decreasing cross-sectional area a portion of which is interposed between said opening and said one section.

36. The apparatus of claim 1, wherein said chamber has a predetermined volume and said admitting means is arranged to deliver the constituents to said chamber at such rate that the mixture of such constituents fills said chamber to at least 50 percent of said volume.

37. The apparatus of claim 36, wherein the mixture fills said chamber at least to between 60 and 70 percent of said volume.

38. The apparatus of claim 36, wherein said chamber is filled to less than 100 percent of said volume.

39. The apparatus of claim 36, wherein said chamber is filled to less than 90 percent of said volume.

40. The apparatus of claim 1, wherein said impeding means is designed so that substantially all parts of the mixture are in said mixing chamber for a period of at least 15 seconds.

41. The apparatus of claim 13, wherein said period is at least 20 seconds.

42. The apparatus of claim 13, wherein said period is at least 30 seconds.

43. The apparatus of claim 13, wherein said period is between 50 and 60 seconds.

44. The apparatus of claim 1, wherein said housing has an internal surface and said mixing and advancing means comprises at least one rotary agitating element having a portion adjacent to said internal surface, and means for rotating said element so that said portion thereof is driven at a speed of between 2 and 3 meters per second.

45. The apparatus of claim 44, wherein said speed is approximately 2.5 meters per second.

46. The apparatus of claim 1, said mixing and advancing means comprising a shaft rotatably mounted in said chamber; and wherein said impeding means includes at least one barrier secured to and rotatable with said shaft, said mixing and advancing means including at least one agitating element secured to said barrier.

47. The apparatus of claim 40, wherein said impeding means comprises a plurality of barriers secured to said shaft and being spaced apart from each other, as considered in the axial direction of said shaft.

48. The apparatus of claim 47, wherein each of said barriers is connected with at least one agitating element.

49. The apparatus of claim 40, wherein said barrier includes a blade.

50. The apparatus of claim 1, wherein said chamber includes an auxiliary mixing section and a main mixing section, said auxiliary mixing section being located adjacent to said admitting means, and the length of said auxiliary mixing section exceeding the length of said main mixing section.

51. The apparatus of claim 50, wherein the length of said auxiliarly section is a multiple of the length of said main section.

52. The apparatus of claim 50, wherein the diameter of said device is less than the diameter of said chamber.

53. The apparatus of claim 50, wherein said auxiliary section is coaxial with and has a discharge end constituting an inlet for admission of the mixture into said main section.

54. The apparatus of claim 1, wherein said impeding means is at least in part constituted by said housing.

55. The apparatus of claim 1, wherein said mixing and advancing means comprises conveying means for transporting the solid constituent into said first section of said chamber.

* * * * *